US008905131B2

(12) United States Patent
Brennan

(10) Patent No.: US 8,905,131 B2
(45) Date of Patent: Dec. 9, 2014

(54) PROBELESS PACKER AND FILTER SYSTEMS

(75) Inventor: William E. Brennan, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 420 days.

(21) Appl. No.: 13/302,902

(22) Filed: Nov. 22, 2011

(65) Prior Publication Data

US 2013/0062051 A1 Mar. 14, 2013

Related U.S. Application Data

(60) Provisional application No. 61/534,263, filed on Sep. 13, 2011.

(51) Int. Cl.
*E21B 33/12* (2006.01)
*E21B 49/10* (2006.01)

(52) U.S. Cl.
CPC ..... *E21B 49/10* (2013.01)
USPC ..... 166/264; 166/100

(58) Field of Classification Search
USPC ..... 166/264, 100; 175/58
See application file for complete search history.

(56) References Cited

U.S. PATENT DOCUMENTS

| | | | | |
|---|---|---|---|---|
| 7,204,309 | B2 | 4/2007 | Segura et al. | |
| 7,458,419 | B2 | 12/2008 | Nold, III et al. | |
| 7,584,786 | B2 | 9/2009 | Nold, III et al. | |
| 7,793,713 | B2 | 9/2010 | Nold, III et al. | |
| 7,804,296 | B2 * | 9/2010 | Flaum et al. | 324/303 |
| 8,408,298 | B2 * | 4/2013 | Briquet et al. | 166/264 |
| 8,490,694 | B2 * | 7/2013 | Corre et al. | 166/264 |
| 2006/0076132 | A1 | 4/2006 | Nold, III et al. | |
| 2008/0125973 | A1 * | 5/2008 | Sherwood et al. | 702/11 |

* cited by examiner

*Primary Examiner* — William P Neuder
(74) *Attorney, Agent, or Firm* — Cathy Hewitt

(57) ABSTRACT

An apparatus described herein includes a formation sampling tool having a body; a packer extendibly mounted to the body and having a first inlet, the first inlet having a first rigid insert fixed to walls of the packer to define the first inlet, the first rigid insert extending partially through the packer; a first filter disposed within the body to filter fluid extracted from a subterranean formation via the first inlet; a first fluid passage to fluidly couple the first inlet to the first filter; and a first piston to slide within the first filter to clean the first filter.

18 Claims, 3 Drawing Sheets

PROBELESS PACKER AND FILTER SYSTEMS

RELATED APPLICATION

This application claims the benefit of the filing date of U.S. Provisional Patent Application No. 61/534,263, filed on Sep. 13, 2011, the entire disclosure of which is incorporated herein by reference in its entirety.

BACKGROUND OF THE DISCLOSURE

Sampling hydrocarbon fluids from subterranean formations involves positioning a downhole tool in a borehole adjacent a formation, sealing an interval of the borehole along the tool and adjacent the formation and extracting sample fluid from the formation. The sample fluid may then be evaluated (e.g., downhole and/or at the surface of the Earth) to facilitate drilling and/or hydrocarbon production operations.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
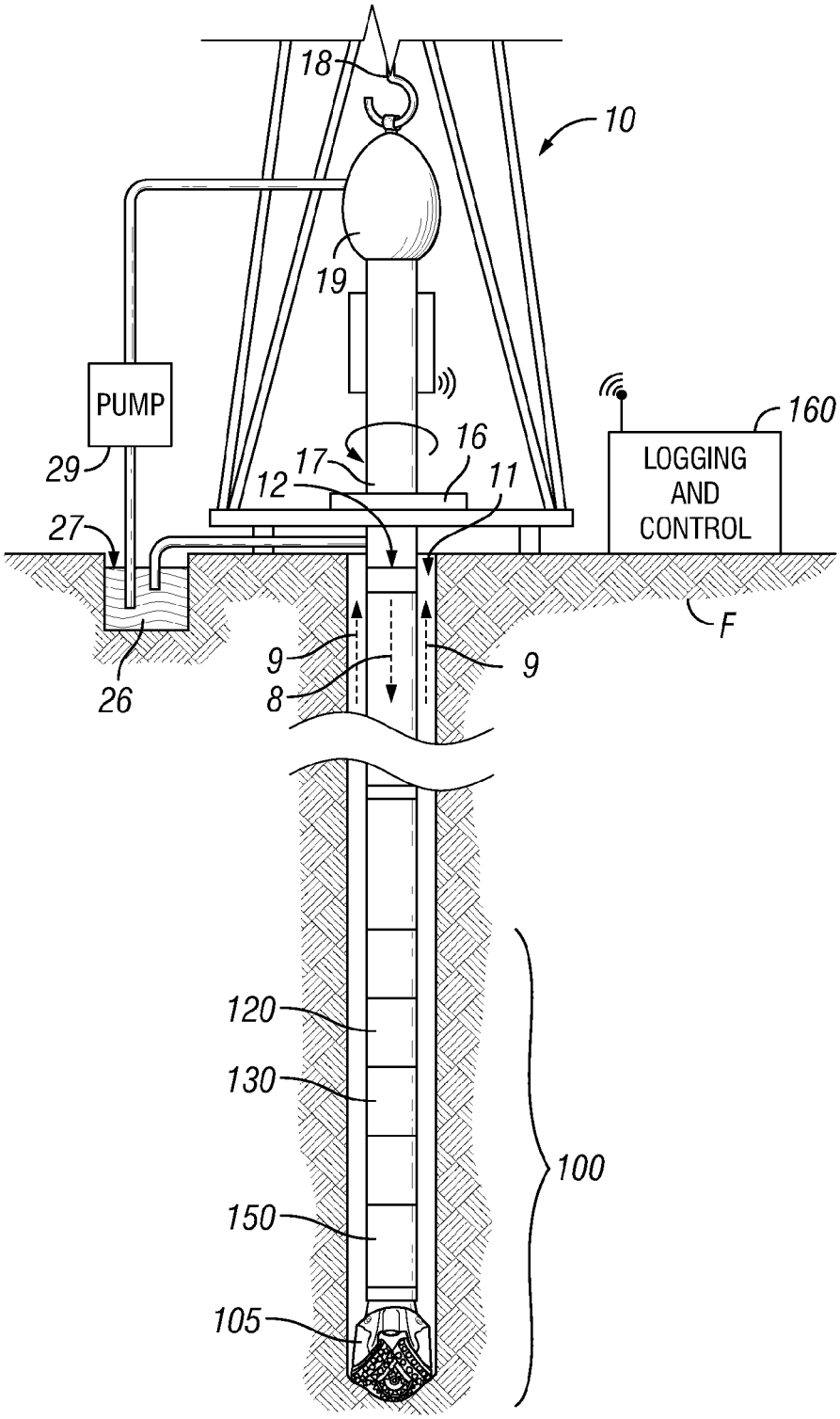
FIG. 1 (Prior Art)
FIG. 1 is a wellsite system according to one or more aspects of the present disclosure.

It is to be understood that the following disclosure provides many different embodiments or examples for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features such that the first and second features may not be in direct contact.

One or more aspects of the present disclosure relate to apparatus to collect fluid samples from subterranean formations. The example apparatus described herein provide packer systems that do not have an extendable probe to collect fluid samples from a subterranean formation. Instead, example packers described herein include one or more inlets defined by rigid inserts (e.g., metallic inserts) fixed to walls of openings in the packers. These rigid inserts support walls of the packers when the packers are forced against a borehole wall and, thus, increase an amount of differential pressure to which the packers may be subjected during sampling operations. However, in the examples described herein, the rigid inserts extend from (e.g., substantially flush with) an outer surface of the packers (e.g., the surface to be pressed against a borehole wall) and partially through a thickness of a body of the packer to preserve compressibility of the packer, thereby enabling the packer to better conform to a curvature of the borehole wall and, thus, to achieve a better seal against the borehole wall.

The example packers described herein may be coupled to a base or shoe to hold the packer and that is extendibly mounted to a body of a downhole tool (e.g., a formation sampling tool). One or more tubes fixed to the shoe may be slidably engaged with openings in the inlets of the packers to provide fluid passages through the packers via the openings and central fluid passages in the tubes. This sliding coupling between the opening in the inlets of the packers and the tubes enables the packers to be more easily compressed and deformed to conform to the curvature of the borehole wall while maintaining one or more fully supported (e.g., lined with metallic surfaces via the tubes and inserts) fluid passages through the packers.

The fluid passages through the packers may be coupled to one or more filters disposed within the body of the downhole tool. Thus, the filters may be used to filter sample fluid extracted from a subterranean formation to prevent contamination from damaging fluid analysis components and/or degrading measurements performed on the fluid samples within the downhole tool. Further, as noted above, due to the compressibility and flexibility of the example packers described herein, the example packers described herein do not have a setting piston and related components and, thus, provide additional space within the body of the downhole tool for use by the one or more filters. The example filters described herein may also include pistons that slide within the filters to actively clean the filters, for example, after each sampling procedure in response to retracting the packers toward the body of the formation sampling tool.

In implementations having multiple inlets such as packer systems having a central fluid inlet surrounded by a guard inlet, the example packers described herein, in addition to not having a separately extendable probe assembly, do not have to separately extend a central portion of the packer (e.g., with a setting piston) to achieve a sufficient seal against the borehole wall. As noted above, the rigid inserts fully support the walls of the packer inlets adjacent the outer surface of the packer to be pressed against a borehole wall, extend partially through the thickness of the body of the packer, and the fluid passages through the inlets defined by the rigid inserts and the tubes slidably are engaged with the rigid inserts. As a result, the example packers described herein remain substantially flexible, compressible and conformable to the surface of a borehole wall, even in implementations requiring a relatively large packer body such as may be used to implement a multi-inlet packer having at least one guard inlet and a central inlet for collecting a fluid sample.

The examples described herein may also include one or more valves to control the operation the pistons within the filters. For example, a relief valve may be used to cause the piston(s) to slide within the filter(s) when the packer is set against a borehole wall. For example, the relief valve pressure may be selected to ensure movement of the piston after the packer is fully set against the borehole wall. In this manner, the drawing of fluid through the inlet(s) of the packer and the filter(s) occurs after the packer is set.

FIG. 1 depicts a wellsite system including downhole tool(s) according to one or more aspects of the present disclosure. The wellsite drilling system of FIG. 1 can be employed onshore and/or offshore. In the example wellsite system of FIG. 1, a borehole 11 is formed in one or more subsurface formations by rotary and/or directional drilling.

As illustrated in FIG. 1, a drill string 12 is suspended in the borehole 11 and includes a bottom hole assembly (BHA) 100 having a drill bit 105 at its lower end. A surface system includes a platform and derrick assembly 10 positioned over the borehole 11. The derrick assembly 10 includes a rotary table 16, a kelly 17, a hook 18 and a rotary swivel 19. The drill string 12 is rotated by the rotary table 16, energized by means not shown, which engages the kelly 17 at an upper end of the drill string 12. The example drill string 12 is suspended from the hook 18, which is attached to a traveling block (not shown), and through the kelly 17 and the rotary swivel 19, which permits rotation of the drill string 12 relative to the hook 18. A top drive system may also be used.

In the example depicted in FIG. 1, the surface system further includes drilling fluid 26, which is commonly referred to in the industry as mud, and which is stored in a pit 27 formed at the well site. A pump 29 delivers the drilling fluid 26 to the interior of the drill string 12 via a port in the rotary swivel 19, causing the drilling fluid 26 to flow downwardly through the drill string 12 as indicated by the directional arrow 8. The drilling fluid 26 exits the drill string 12 via ports in the drill bit 105, and then circulates upwardly through the annulus region between the outside of the drill string 12 and the wall of the borehole 11, as indicated by the directional arrows 9. The drilling fluid 26 lubricates the drill bit 105, carries formation cuttings up to the surface as it is returned to the pit 27 for recirculation, and creates a mudcake layer (not shown) on the walls of the borehole 11.

The example bottom hole assembly 100 of FIG. 1 includes, among other things, any number and/or type(s) of logging-while-drilling (LWD) modules or tools (one of which is designated by reference numeral 120) and/or measuring-while-drilling (MWD) modules (one of which is designated by reference numeral 130), a rotary-steerable system or mud motor 150 and the example drill bit 105. The MWD module 130 measures the drill bit 105 azimuth and inclination that may be used to monitor the borehole trajectory.

The example LWD tool 120 and/or the example MWD module 130 of FIG. 1 may be housed in a special type of drill collar, as it is known in the art, and contains any number of logging tools and/or fluid sampling devices. The example LWD tool 120 includes capabilities for measuring, processing and/or storing information, as well as for communicating with the MWD module 130 and/or directly with the surface equipment, such as, for example, a logging and control computer 160.

The logging and control computer 160 may include a user interface that enables parameters to be input and or outputs to be displayed that may be associated with the drilling operation and/or the formation traversed by the borehole 11. While the logging and control computer 160 is depicted uphole and adjacent the wellsite system, a portion or all of the logging and control computer 160 may be positioned in the bottom hole assembly 100 and/or in a remote location.

Figure 2:
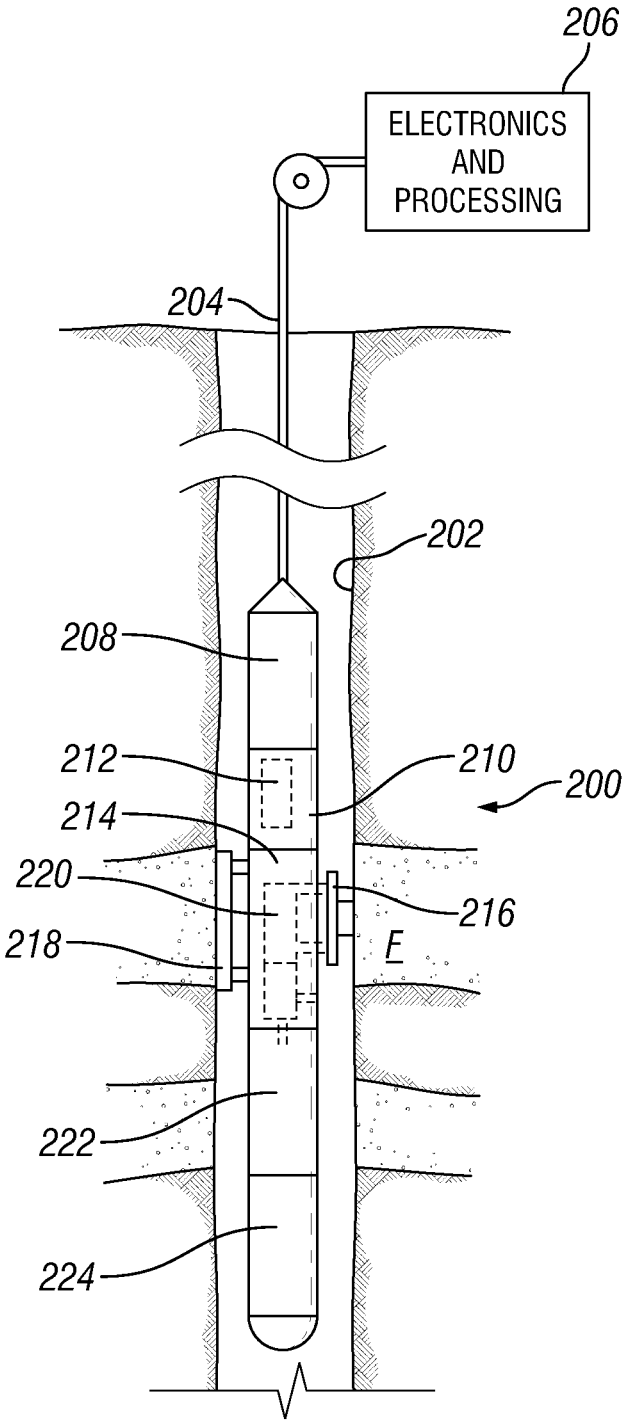
FIG. 2 is a wireline system according to one or more aspects of the present disclosure.

FIG. 2 depicts an example wireline system including downhole tool(s) according to one or more aspects of the present disclosure. An example wireline tool 200 may be used to extract and analyze formation fluid samples and is suspended in a borehole or wellbore 202 from the lower end of a multiconductor cable 204 that is spooled on a winch (not shown) at the surface. At the surface, the cable 204 is communicatively coupled to an electrical control and data acquisition system 206. The tool 200 has an elongated body 208 that includes a collar 210 having a tool control system 212 configured to control extraction of formation fluid from a formation F and measurements performed on the extracted fluid.

The wireline tool 200 also includes a formation tester 214 having a selectively extendable fluid admitting assembly 216 and a selectively extendable tool anchoring member 218 that are respectively arranged on opposite sides of the body 208. The fluid admitting assembly 216 is configured to selectively seal off or isolate selected portions of the wall of the wellbore 202 to fluidly couple to the adjacent formation F and draw fluid samples from the formation F. The formation tester 214 also includes a fluid analysis module 220 through which the obtained fluid samples flow. The fluid may thereafter be expelled through a port (not shown) or it may be sent to one or more fluid collecting chambers 222 and 224, which may receive and retain the formation fluid for subsequent testing at the surface or a testing facility.

In the illustrated example, the electrical control and data acquisition system 206 and/or the downhole control system 212 are configured to control the fluid admitting assembly 216 to draw fluid samples from the formation F and to control the fluid analysis module 220 to measure the fluid samples. In some example implementations, the fluid analysis module 220 may be configured to analyze the measurement data of the fluid samples as described herein. In other example implementations, the fluid analysis module 220 may be configured to generate and store the measurement data and subsequently communicate the measurement data to the surface for analysis at the surface. Although the downhole control system 212 is shown as being implemented separate from the formation tester 214, in some example implementations, the downhole control system 212 may be implemented in the formation tester 214.

One or more modules or tools of the example drill string 12 shown in FIG. 1 and/or the example wireline tool 200 of FIG. 2 may employ the example apparatus described herein. While the example apparatus described herein are described in the context of drillstrings and/or wireline tools, they are also applicable to any number and/or type(s) of additional and/or alternative downhole tools such as coiled tubing deployed tools.

Figure 3:
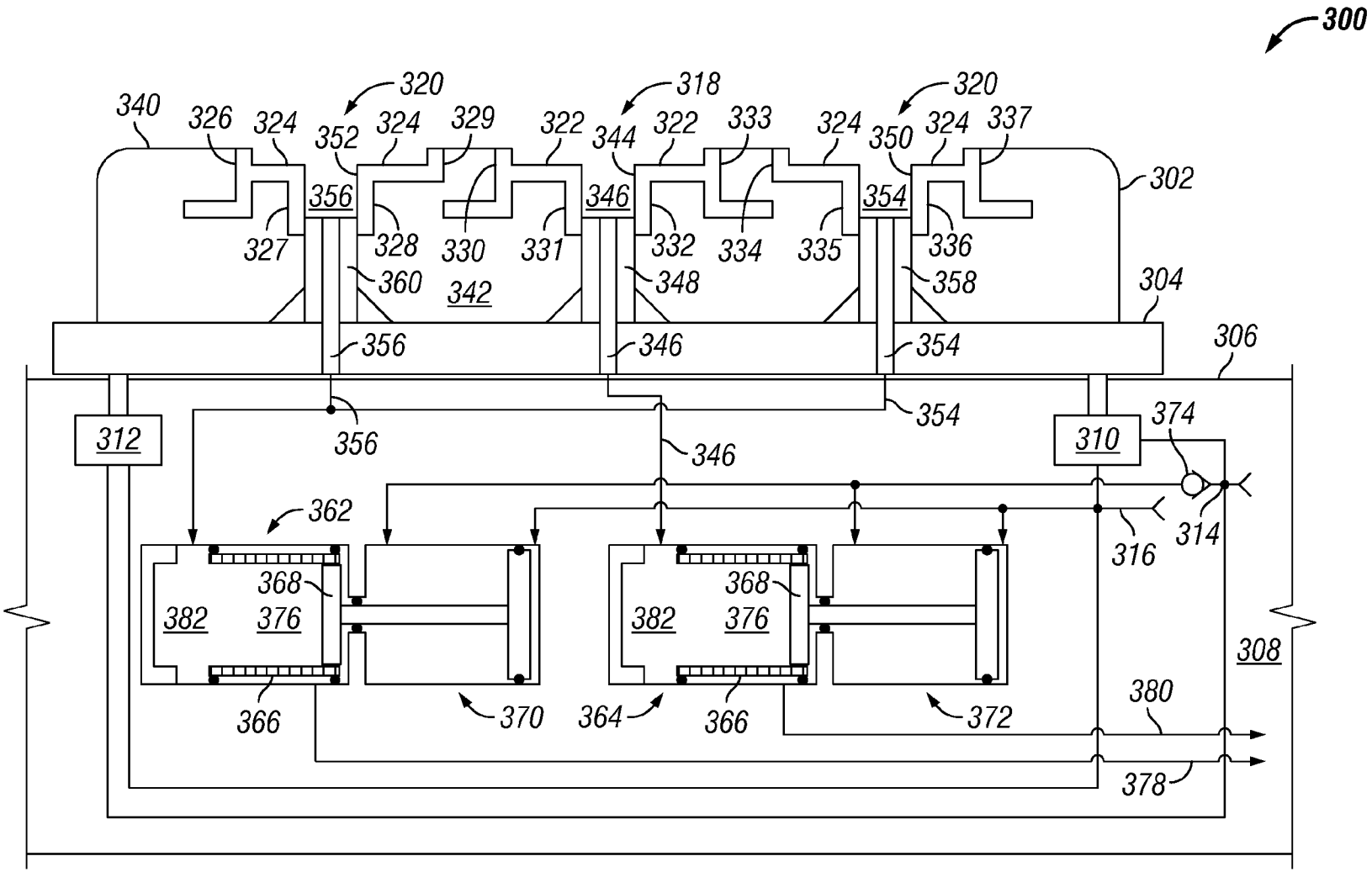
FIG. 3 is a schematic view of apparatus according to one or more aspects of the present disclosure.

FIG. 3 is a schematic diagram of an example probeless packer and filter system 300 that may be used to perform formation fluid sampling operations. The example system 300 includes a packer 302 coupled to a base or shoe 304 that is extendibly mounted to a body 306 of a downhole tool (e.g., a formation sampling tool) 308. One or more hydraulic pistons 310 and 312 may be used to extend and retract the base or shoe 304 to cause the packer 302 to be sealingly engaged against a borehole wall to extract a fluid sample from a formation and to cause the packer 302 to be withdrawn from the borehole wall at the completion of the extraction of the fluid sample. More specifically, a set line 314 provides a hydraulic signal to extend the base or shoe 304 to sealingly engage the packer 302 against the borehole wall, and a retract line 316 provides a hydraulic signal to retract the base or shoe 304 to disengage the packer 302 from the borehole wall.

The example packer 302 of FIG. 3 includes a first or central inlet 318 and a second or guard inlet 320. The inlets 318 and 320 include respective rigid inserts 322 and 324. The rigid inserts 322 and 324 may be made of a metallic material and/or any other material sufficiently rigid to support walls 326-337 of the packer 302. In the example of FIG. 3, the inserts 322 and 324 are substantially flush with an outer surface 340 of the packer 302 and extend partially through a body 342 of the packer. By extending partially through the body 342 of the packer 302, the packer 302 remains substantially flexible and compressible to facilitate conformance and sealing of the outer surface 340 of the packer 302 against the borehole wall. The inserts 322 and 324 may be fixed to the walls 326-337 of the packer 302 by, for example, molding the inserts 322 and 324 with the packer 302, which may be made of a rubber or other elastomeric material. Further, the inserts 322 and 324 may have a different geometry or shape than shown in the example of FIG. 3. For example, the inserts 322 and 324 may be recessed or extend from the outer surface 340 rather than having a flush relationship to the outer surface 340, and the inserts 322 and 324 may extend more or less into the body 342 of the packer 302 than depicted in FIG. 3.

The insert 322 of the central inlet 318 defines an opening 344, which functions as a part of a fluid passage 346. A tube 348, which also defines part of the fluid passage 346, is fixed to the base or shoe 304 and slidably engaged with the opening 344. Similarly, the insert 324 of the guard inlet 320 defines two openings 350 and 352, which function as part of two respective fluid passages 354 and 356. Tubes 358 and 360, which also define part of the respective fluid passages 354 and 356, are fixed to the base or shoe 304 and slidably engaged with the openings 354 and 356. The sliding engagement of the tubes 348, 358 and 360 with the openings 344, 350 and 352 further enables the packer 302 to remain sufficiently flexible and compressible while at the same time providing full support to the fluid passages 346, 354 and 356 from the outer surface 340 of the packer 302 to the body 306 of the downhole tool 308.

While the example of FIG. 3 depicts the packer 302 having the central inlet 310 and the guard inlet 320, any number of inlets may be used without departing from the scope of the disclosure. Further, the shape or geometry of the inlets 310 and 320 may be circular, elliptical, polygonal or any other shape or combination of shapes. Still further, the number of openings and/or fluid passages may be increased or decreased as needed to suit the needs of a particular application without departing from the scope of the disclosure.

The example of FIG. 3 also includes first and second filters 362 and 364. Each of the filters 362 and 364 includes a filter element 366 and a piston 368 to slide within the filter element 366 to clean (e.g., to actively clean) the filter element 366. Each of the pistons 368 is coupled to a respective actuator 370 and 372 that moves the piston 368 in response to hydraulic signals from the set and retract lines 314 and 316. In particular, the set line 314 is used to cause the actuators 370 and 372 to move the pistons 368 to the right in the orientation of FIG. 3, thereby enabling the first filter 362 to receive fluid via the fluid passages 354 and 356 that are fluidly coupled to the guard inlet 320 and enabling the second filter 364 to receive fluid via the fluid passage 346 that is fluidly coupled to the central inlet 318. More specifically, a valve 374 may open at a pressure that corresponds to a condition at which the pistons 310 and 312 have set the packer 302 against a borehole wall. For example, the valve 374 may open at about 1000 psig to enable the hydraulic signal conveyed via the set line 314 to cause the pistons 368 to move to the right in the orientation of FIG. 3 to open a filter chamber 376 to receive fluid via the fluid passages 346, 354 and 356 and allow the fluid to pass through the filter elements 366 to filter the fluid before passing the fluid to be stored and/or tested via lines 378 and 380.

After a fluid sampling operation is complete, a hydraulic signal on the retract line 316 may cause the actuators 370 and 372 to move the pistons 368 to the left in the orientation of FIG. 3, thereby causing the pistons 368 to slide within and clean the filter elements 366 and push contaminates into a collection area 382. The pistons 368 may remain in the leftmost position until a sampling operation is initiated and the packer 302 has been set and the pressure of the hydraulic fluid in the set line 314 is sufficiently high to open the valve 374. The pistons 368 may be sized to fit tightly against the inner surfaces of the filter elements 366 to efficiently scrape contaminates (e.g., mudcake, dirt, etc.) from the inner surfaces of the filter elements 366.

While the example shown in FIG. 3 includes two filters, more or fewer filters may be used instead to suit the needs of a particular application. Further, while the filters 362 and 364 of the example of FIG. 3 are coupled to the set line 314 and the retract line 316 to provided hydraulic signals to cause the filters 362 and 364 to be cleaned after each sampling, another manner of causing the cleaning may be used. For example, separate hydraulic lines may be employed to cause the pistons 368 to slide within the filters 362 and 364 multiple times prior to and/or following a sampling operation.

Additionally, although FIG. 3 depicts the filters 362 and 364 and/or the actuators 370 and 372 mounted or located within the body 306 of the downhole tool 308, any or all these components may instead be mounted or contained within the base or shoe 304. Further, the collections areas 382 within the filters 362 and 364 may be sized to collect a predetermined volume of debris to suit the needs of an application. Also, although not shown, the filters 362 and 364 may also include respective bypass devices such as rupture disks that may open in response to the filters 362 and 364 being full of debris. Such a full condition may, for example, be detected in the event the respective pistons 368 do not reach a full travel (e.g., end of stroke) condition. In any event, once the bypass devices have opened, operations may continue.

As can be appreciated, the foregoing disclosure introduces an apparatus comprising: a formation sampling tool having a body; a packer extendibly mounted to the body and having a first inlet, the first inlet having a first rigid insert fixed to walls of the packer to define the first inlet, and the first rigid insert extending partially through the packer; a first filter disposed within the body to filter fluid extracted from a subterranean formation via the first inlet; a first fluid passage to fluidly couple the first inlet to the first filter; and a first piston to slide within the first filter to clean the first filter. The apparatus may also include a tube slidably engaged with an opening in the first inlet defined by the first rigid insert, the tube fluidly coupling the first inlet to the first fluid passage. A shoe may be included to hold the packer, wherein the tube is fixed to the shoe. The insert may comprise a metallic material. The apparatus may further include a second fluid passage to fluidly couple the first inlet to the first filter. The apparatus may further include a second inlet to function as a guard for the first inlet, the second inlet having a second rigid insert fixed to walls of the packer to define the second inlet. The apparatus may further include a second filter disposed within the body to filter fluid extracted from the subterranean formation via the second inlet, a second fluid passage to fluidly couple the second inlet to the second filter, and a second piston to slide within the second filter to clean the second filter. The apparatus may further include a third fluid passage to fluidly couple the second inlet to the second filter or the first inlet to the first filter. The apparatus may further include tubes slidably engaged with openings in the inlets defined by the rigid inserts, the tubes fluidly coupling the first inlet to the first fluid passage and the second inlet to the second fluid passage. The inserts may comprise a metallic material. Still further, the apparatus may further include a valve to cause the first piston to slide within the first filter when the packer is set against a borehole wall. Alternatively or additionally, the first piston may slide within the first filter to clean the filter in response to retracting the packer toward the body of the formation sampling tool.

The disclosure further introduces an apparatus comprising: a packer to be mounted to a formation sampling tool and having a first inlet; and a first metallic insert fixed to walls of the packer to define the first inlet, the first metallic insert substantially flush with an outer surface of the packer to contact a borehole wall and extending partially into the packer, the first metallic insert forming a first opening within the packer to slidably receive a first tube coupled to a base for the packer, the first opening to provide a first fluid passage for fluid extracted from a subterranean formation. The apparatus may further comprise a second inlet to function as a guard for the first inlet; a second metallic insert fixed to walls of the packer to define the second inlet, the second metallic insert substantially flush with the outer surface of the packer and extending partially into the packer, the second metallic insert forming a second opening within the packer to slidably receive a second tube coupled to the base for the packer, the second opening to provide a second fluid passage for fluid extracted from the subterranean formation. The first inlet may be centrally disposed in the packer and the second inlet may surround the first inlet. Each of the first and second inlets may have a circular shape. The apparatus may further comprise a third opening formed in the first metallic insert or the second metallic insert, the third opening to slidably receive a third tube coupled to the base for the packer, the third opening to provide a third fluid passage for fluid extracted from the subterranean formation. Each of the metallic inserts may be molded with the packer.

The disclosure further introduces an apparatus comprising: a first filter to be mounted within a formation sampling tool such that a packer shoe is disposed between the first filter and an inlet of a packer mounted to the packer shoe, the first filter to filter fluid extracted from a subterranean formation and to be fluidly coupled via a fluid passage within the formation sampling tool to the inlet of the packer; and a first piston to slide within the first filter to clean the first filter. The apparatus may further comprise a second filter mounted with the formation sampling tool, the second filter to filter fluid extracted from the subterranean formation and to be fluidly coupled via another fluid passage within the formation sampling tool to another inlet of the packer, and a second piston to slide within the second to clean the second filter. At least one of the first or second pistons may clean a corresponding one of the first or second filters in response to a signal to retract the packer.

Although only a few example embodiments have been described in detail above, those skilled in the art will readily appreciate that many modifications are possible in the example embodiments without materially departing from this disclosure. Accordingly, all such modifications are intended to be included within the scope of this disclosure as defined in the following claims. In the claims, means-plus-function clauses are intended to cover the structures described herein as performing the recited function and not only as structural equivalents, but also equivalent structures. Thus, although a nail and a screw may be not structural equivalents in that a nail employs a cylindrical surface to secured wooden parts together, whereas a screw employs a helical surface, in the environment of fastening wooden parts, a nail and a screw may be equivalent structures. It is the express intent of the applicant not to invoke 35 U.S.C. §112, paragraph 6 for any limitations of any of the claims herein, except for those in which the claim expressly uses the words "means for" together with an associated function.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a formation sampling tool having a body;

a packer extendibly mounted to the body and having a first inlet, the first inlet having a first rigid insert fixed to walls of the packer to define the first inlet, the first rigid insert extending partially through the packer;

a first filter disposed within the body to filter fluid extracted from a subterranean formation via the first inlet;

a first fluid passage to fluidly couple the first inlet to the first filter; and a first piston to slide within the first filter to clean the first filter.

2. The apparatus of claim 1 further comprising a tube slidably engaged with an opening in the first inlet defined by the first rigid insert, the tube fluidly coupling the first inlet to the first fluid passage.

3. The apparatus of claim 2 further comprising a shoe to hold the packer, wherein the tube is fixed to the shoe.

4. The apparatus of claim 1 wherein the insert comprises a metallic material.

5. The apparatus of claim 1 further comprising a second inlet to function as a guard for the first inlet, the second inlet having a second rigid insert fixed to walls of the packer to define the second inlet.

6. The apparatus of claim 5 further comprising:

a second filter disposed within the body to filter fluid extracted from the subterranean formation via the second inlet;

a second fluid passage to fluidly couple the second inlet to the second filter; and a second piston to slide within the second filter to clean the second filter.

7. The apparatus of claim 6 further comprising tubes slidably engaged with openings in the inlets defined by the rigid inserts, the tubes fluidly coupling the first inlet to the first fluid passage and the second inlet to the second fluid passage.

8. The apparatus of claim 5 wherein the each of the inserts comprises a metallic material.

9. The apparatus of claim 1 further comprising a valve to cause the first piston to slide within the first filter when the packer is set against a borehole wall.

10. The apparatus of claim 1 wherein the first piston slides within the first filter to clean the filter in response to retracting the packer toward the body of the formation sampling tool.

11. An apparatus, comprising:

a packer to be mounted to a formation sampling tool and having a first inlet; and a first metallic insert fixed to walls of the packer to define the first inlet, the first metallic insert substantially flush with an outer surface of the packer to contact a borehole wall and extending partially into the packer, the first metallic insert forming a first opening within the packer to slidably receive a first tube coupled to a base for the packer, the first opening to provide a first fluid passage for fluid extracted from a subterranean formation.

12. The apparatus of claim 11 further comprising:

a second inlet to function as a guard for the first inlet;

a second metallic insert fixed to walls of the packer to define the second inlet, the second metallic insert substantially flush with the outer surface of the packer and extending partially into the packer, the second metallic insert forming a second opening within the packer to slidably receive a second tube coupled to the base for the packer, the second opening to provide a second fluid passage for fluid extracted from the subterranean formation.

13. The apparatus of claim 12 wherein the first inlet is centrally disposed in the packer and the second inlet surrounds the first inlet.

14. The apparatus of claim 13 wherein each of the first and second inlets has a circular shape.

15. The apparatus of claim 12 wherein each of the metallic inserts is molded with the packer.

16. An apparatus, comprising:

a first filter to be mounted within a formation sampling tool such that a packer shoe is disposed between the first filter and an inlet of a packer mounted to the packer shoe, the first filter to filter fluid extracted from a subterranean formation and to be fluidly coupled via a fluid passage within the formation sampling tool to the inlet of the packer; and a first piston to slide within the first filter to clean the first filter.

17. The apparatus of claim 16 further comprising:

a second filter mounted with the formation sampling tool, the second filter to filter fluid extracted from the subterranean formation and to be fluidly coupled via another fluid passage within the formation sampling tool to another inlet of the packer; and a second piston to slide within the second to clean the second filter.

18. The apparatus of claim 17 wherein at least one of the first or second pistons is to clean a corresponding one of the first or second filters in response to a signal to retract the packer.

* * * * *